350-171 SR
3/30/82 XR 4,321,778

United States Patent [19]

Whitehead

[11] 4,321,778

[45] Mar. 30, 1982

[54] GLASS PANES AND BUILDINGS INCLUDING GLASS PANES

[75] Inventor: Merill Whitehead, Castle Hill, Australia

[73] Assignee: Twin View Glass, Inc., Spring Valley, N.Y.

[21] Appl. No.: 75,935

[22] Filed: Sep. 17, 1979

[51] Int. Cl.[3] ..... E04B 2/56; A63B 61/00

[52] U.S. Cl. ..... 52/397; 52/105; 273/29 R; 350/171

[58] Field of Search ..... 52/105, 171, 397; 350/169, 172, 171, 263; 160/241; 428/210, 426; 273/29 R

[56] References Cited

U.S. PATENT DOCUMENTS

| | | | |
|---|---|---|---|
| 1,199,882 | 10/1916 | Frey | 350/291 |
| 1,938,085 | 12/1933 | Page | 350/262 |
| 2,009,167 | 7/1935 | Delano | 350/263 |
| 2,327,918 | 8/1943 | Miller | 350/263 |
| 3,085,474 | 4/1963 | Bourgeaux | 160/166 R |
| 3,560,093 | 2/1971 | Montone | 350/291 |
| 3,652,370 | 3/1972 | Motal | 350/276 R |
| 3,694,945 | 10/1972 | Detiker | 350/172 |
| 3,745,678 | 7/1973 | Thomassen | 350/291 |
| 4,006,565 | 2/1977 | Thompson | 273/29 R |
| 4,056,648 | 11/1977 | Richardson | 428/210 |
| 4,167,839 | 9/1979 | Nielsen | 52/105 |

FOREIGN PATENT DOCUMENTS

| | | | |
|---|---|---|---|
| 715600 | 1/1942 | Fed. Rep. of Germany | 350/172 |

*Primary Examiner*—Price C. Faw, Jr.
*Assistant Examiner*—Henry E. Raduazo
*Attorney, Agent, or Firm*—James D. Fornari

[57] ABSTRACT

The present invention relates to a glass pane whereby a broken pattern of white and black opaque material is applied to the surface or surfaces of the glass pane such that concentrated light from one side of the glass is reflected to such an extent that persons on that side of the glass may see the wall and may "read" the path of an object moving relative to said wall whilst persons disposed on the other side of said wall may see through the wall to a sufficient extent to also follow the path of said moving object. The glass panels of the present invention are particularly suitable for wall members for a squash, handball, racquet-ball or like court.

15 Claims, 6 Drawing Figures

50
51
52
A
B
C
D
E
F
G
H
I 50
51
52
53
A
B
C
D
E
F
G
H
I
J
K
L
M 50
51
52
53
A
B
C

GLASS PANES AND BUILDINGS INCLUDING GLASS PANES

This invention relates to glass panes and to buildings and the like including glass panes.

There are occasions when it is desired that persons on one side of a glass pane can view what is happening on the other side without undue loss of clarity while persons on the said other side are not unduly distracted by reflections from the pane and by persons moving on the said other side. An example is where the whole or part of one or more walls of a squash court consists of a glass pane, with spectators on one side and players on the other. Differential lighting, with the playing area well-lit, and the seating area not so well lit, assists in attaining this objective, but an ordinary transparent glass pane cannot be used successfully except for the back wall. The present invention provdides glass panes which will enable the said objective to be achieved when used for the side and/or front wall of a squash court as well as the back wall. The panes, of course, have other uses than for squash courts.

The invention, in one broad form, provides a glass pane having a broken pattern of dots or lines of a laminate formed of white and black opaque materials applied to the pane, the pattern being such that concentrated light from one side of the glass is reflected to such an extent that persons on that side of the glass may see the wall and may "read" the path of an object moving relative to said wall whilst persons disposed on the other side of said wall may see through the wall to a sufficient extent to also follow the path of said moving object.

The invention will now be described with reference to glass panes for use in squash courts and to the accompanying drawings in which.

Squash courts have already been built in which the back wall is made of hardened plate glass with a spectator viewing area behind the glass wall. This enables more people to view a game than when an opaque back wall is used, the additional spectators viewing the game through the glass. Negligible inconvenience to the players is caused because the players have their backs to the back wall for most of the play. However, serious inconvenience would be caused if ordinary hardened plate glass were used for the whole or part of the side and front walls, due to reflections from the glass surface and due to movement of spectators behind the glass.

It has now been found that satisfactory results are obtained if glass panes, made in accordance with this invention are used for the whole, or a part, of any of the walls of a squash court. The present invention is further improved if differential lighting is used. The players receive sufficient reflected light from the walls to "read" the wall, while enough light passes through the pattern to allow the audience to see the game; differential lighting ensures that the players cannot see the audience and thus be distracted by them and the audience are aware of the pattern only as a faint film, if at all.

Figure 1:
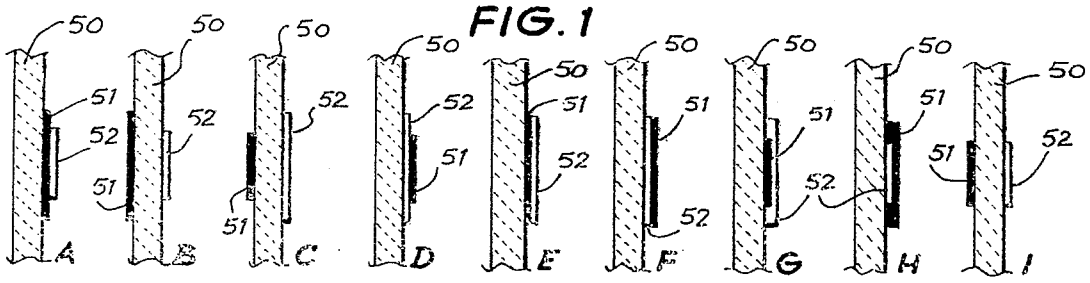
FIGS. 1A to 1I show schematic drawings representing various forms of a dot formed by the white opaque and black opaque material on a pane of glass according to one form of embodiment of the present invention.
Figure 2:
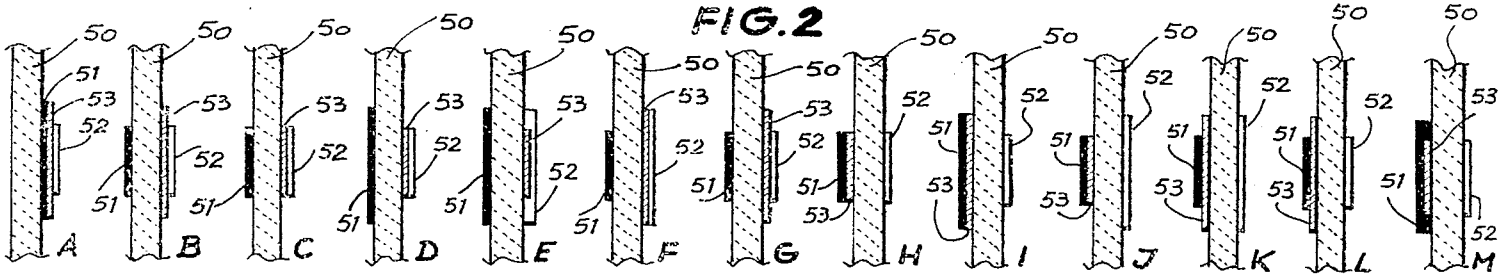
FIGS. 2A to 2M show schematic drawings representing various forms of a dot formed from a black opaque material, a white opaque material and a reflective material therebetween on a glass pane according to other embodiments of the present invention.

The pattern can be formed by dots, lines or any suitable shapes made up of white opaque and black opaque material. FIGS. 1A to 1I show some of the various layer orientations that the glass pane 50, black opaque material 51 and the white opaque material 52 can take. In these cases the opaque materials are in the forms of dots. The dots can be superimposed and of the same size as shown in FIGS. 1E and 1F or of superimposed and different sizes as shown in FIGS. 1A, 1D, 1G and 1H. The dots could be on different surfaces of the glass pane 50 as shown in FIGS. 1B, 1C or 1I.

A further form of dot according to another form of the present invention utilizes a reflective material between the white and black opaque materials to increase reflectivity. This reflective material can be a foil, a ceramic paint or any other suitable material. Preferably the material is silver or white in colour. Various orientations of the three materials forming a dot in these cases relative to a glass pane are shown in FIGS. 2A to 2M, in which the glass pane is designated by 50, the black opaque material by 51, the reflective material by 53 and the white opaque material by 52. The reflective material 53 and the black opaque material 51 can be on the same side of glass pane 50 with the white opaque material 52 on the other side as shown in FIGS. 2H, 2I, 2J, 2K, 2L and 2M or the reflective material 53 and the white opaque material 52 can be on the same side of the glass pane with the black opaque material 51 on the other side of the glass pane 50. Also the three materials can be on the same side of the glass pane, and of course be of the same or different sizes.

Figure 3:
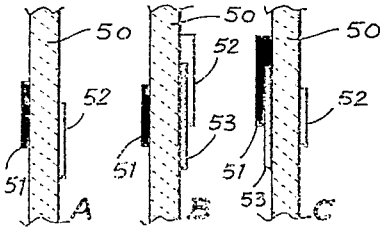
FIGS. 3A to 3C show schematic drawings representing views of a dot of other forms of the present invention.

The materials can be offset from each other as shown in FIGS. 3A to 3C.

In one embodiment of this invention the dots are applied to the glass surface by silk-screening a ceramic ink onto plate glass. Also the dots can be applied by the Decal method. This method is as follows: A metal printing screen is made to give a dot pattern of between 10 and 16 dots to the lineal inch (ideally 11–14 dots to lineal inch), allowing 50% light transmittal through the intermittal clear spaces between the dots. Normal screen printing procedure is adopted, first printing onto suitable carrier paper, a solution of clear lacquer which then acts as the carrier for the actual printing of the coloured ink dots. Onto this clear lacquer, a further screen printing procedure is carried out, but with white ceramic ink, giving a white dot pattern, and dried off. Finally, the process is repeated but with a perfectly registered coat of black ceramic ink, and dried off. The finished product is a decal or transfer, with black on white dots, held on to a carrier paper by the first coat of clear lacquer.

The decal is then immersed in pure distilled water and placed black dot face down onto the required glass, usually between $\frac{1}{8}''$ and 1" thick dependant on the use, but ideally for squash and racquet-ball between $\frac{1}{2}''$ and $\frac{3}{4}''$ thick. The carrier paper is peeled off and the decal slid or eased into the required position. The process is repeated depending on the size of decal used and size of glass required until the decals, suitably butted together, cover the whole surface of the glass.

The glass is then tempered or toughened in the normal way having been left to dry off for a period of between 10 to 20 hours, ideally 16, or is subjected to fast heat drying process so all moisture trapped between the decal and glass during application dissipates.

The glass is subjected during this process to temperatures of up to 1100° F./1400° F. at approximately 600° F./800° F., the clear lacquer which was carrying the dots is "burnt off" and the dots "burnt in" to the glass, leaving a panel which is seen to have black dots on one side and white dots on the other.

Subsequent heat toughening of the glass fuses the ceramic ink into the glass surface. An additional advantage of this process is that the pattern gives the glass a slightly raised texture which provides the squash ball with a "grip" similar to the surface of a conventional squash court wall. The pattern may preferably cover from 30% to 60% of the glass surface. A preferred dot distribution is 10 to 30 dots or lines to the linear inch for a squash court wall, although this can be varied according to the uses to which the glass panes are put.

As mentioned previously it is not necessary that the dots be the same size. The dots could overlap or consist of concentric circles of the black and white material with either the black or white forming the centre or being covered by the other coloured material.

The dots can be so arranged so as to form individual lines of groups of dots or the dots could be applied at a random spacing or an even spacing over the glass pane. The white material can be placed on one side of the glass pane with the black material on the other. The dots may be applied to any side of the glass pane, but preferably the white dots and silver dots should, in the case of the glass panes being used as walls of a squash court, be on the player's side of the glass pane.

The glass panes can be used as a strip set into a wall or the walls of a squash court, or other building, in a similar manner to that in which plate glass windows are mounted in a wall. Alternatively, all of one wall, or all walls, may be constructed from the glass panes. The construction may be demountable one giving a squash court that can be transported from one place to another.

Figure 5:
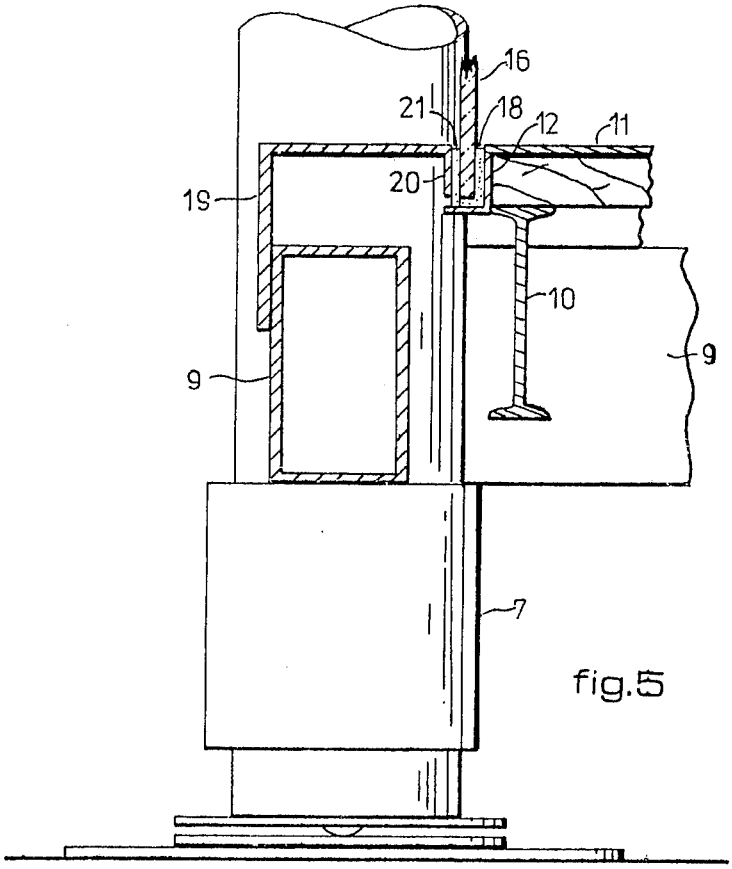
FIG. 5 is a fragmentary section on the line 5—5 in FIG. 4, to an enlarged scale.
Figure 6:
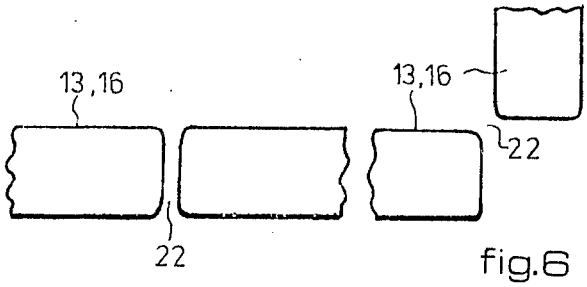
FIG. 6 is a fragmentary plan view of adjacent glass sheets showing the unfilled gap between said sheets.

A preferred embodiment of a demountable squash court incorporating glass pane walls according to this invention will now be described with reference to FIGS. 4, 5 and 6 of the accompanying drawings.

Figure 4:
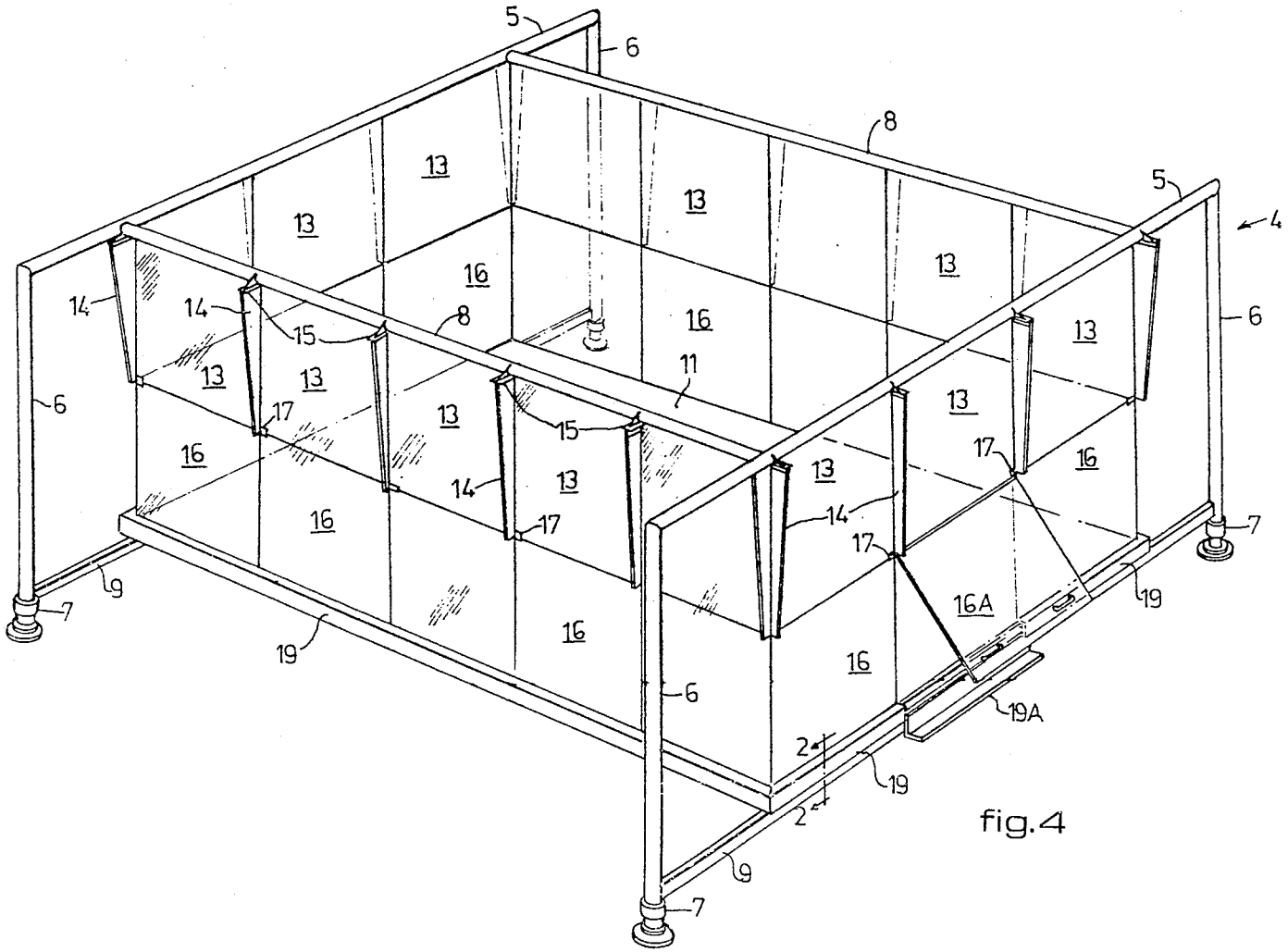
FIG. 4 is a perspective view of the squash court.

The squash court as illustrated in FIG. 4 comprises end frames 4 built up from horizontal tubular members 5 secured to the upper ends of vertical tubular standards 6. Each standard is provided with resilient pedestals 7, and the end frames are joined by longitudinal tubular members 8, the ends of which are secured to the members 5.

Floor beams 9 of rectangular cross section extend between the vertical members 6 approximately one meter above the base of the pedestals 7. Floor joints 10 (see FIG. 5) extend between the beams 9, and support a playing floor surface 11. A trough 12 is formed about the periphery of the floor 11 for a purpose to be described later.

A series of glass panels 13 are suspended from the tubular members 5 and 8, and said panels are provided with a pattern of black over white or white over black lines (not shown).

Outrigger vertical glass gussets 14 are rigidly secured to metal brackets 15 extending tangentially from the underside of the tubular members 5 and 8. The gussets 14 are positioned adjacent the junction of each sheet 13 and support them in a vertical plane.

A second row of glass panels 16 are secured to the lower edges of the panels 13 by means of plates 17. The lower edges of the panels 16 are accommodated within the floor trough 12 (see FIG. 5) and a felt pad 18 is positioned between the glass and the trough 12.

An angular facia member 19 is secured to the outer surfaces of the members 9 with an inner face 20 of said facia 19 positioned adjacent the glass panels 16. A second felt pad 21 is positioned between the glass 16 and the facia 19.

One panel 16A is hingedly secured at its upper edge to the glass end wall so that it can be opened as an access door as shown in FIG. 4. A short length 19A of the facia 19 adjacent the panel 16A is hingedly secured thereto so it can be swung down to form a step to assist access.

To allow for expansion due to temperature changes an unfilled gap must be provided between the edges of the glass sheets 13 and 16. This gap of three millimeters is shown at 22 in FIG. 6.

What I claim is:

1. A glass pane having a broken pattern of dots or lines formed by white opaque material applied to one side of the glass pane with black opaque material applied to the other side of said glass pane, said dots or lines of the two materials being in substantial alignment and said black opaque material being placed upon a pattern of silver material, in the form of dots or lines, the pattern being such that concentrated light from one side of the glass is reflected to such an extent that persons on that side of the glass may see the wall and may "read" the path of an object moving relative to said wall whilst persons disposed on the other side of said wall may see through the wall to a sufficient extent to also follow the path of said moving object.

2. A glass pane according to claim 1 wherein the surfaces of material forming the broken pattern are such as to randomly reflect light falling thereon.

3. A glass pane according to claim 1 wherein the pattern is applied as ceramic inks fused into the glass surface during a heat toughening step.

4. A glass pane according to claim 1 wherein the pattern is formed from ceramic inks as a decal and the decal is then applied to the glass pane and the ceramic inks fused into the glass surface during a heat toughening step.

5. A glass pane according to claim 2 wherein said pattern occupies 30% to 60% of the pane surface.

6. A glass pane according to claim 2 wherein said pattern comprises 10 to 30 dots or lines to the linear inch.

7. A glass pane having a broken pattern of dots or lines formed of white and black opaque materials with an intermediate reflective material layer, applied to form a laminated structure therewith, the pattern being such that concentrated light from one side of the glass is reflected to such an extent that persons on that side of the glass may see the wall and may "read" the path of an object moving relative to said wall whilst persons disposed on the other side of said wall may see through the wall to a sufficient extent to also follow the path of said moving object.

8. A glass pane according to claim 7 wherein said white and reflective materials are superimposed over said black opaque material.

9. A glass pane according to claim 8 wherein the surfaces of material forming the broken pattern are such as to randomly reflect light falling thereon.

10. A glass pane according to claim 9 wherein the pattern is applied as ceramic inks fused into the glass surface during a heat toughening step.

11. A glass pane according to claim 9 wherein the pattern is formed from ceramic inks as a decal and the decal is then applied to the glass pane and the ceramic inks fused into the glass surface during a heat toughening step.

12. A glass pane according to claim 9 wherein said pattern occupies 30% to 60% of the pane surface.

13. A glass pane according to claim 9 wherein said pattern comprises 10 to 30 dots or lines to the linear inch.

14. A squash, handball, racquet-ball or like court comprising a plurality of panes of glass as defined in any one of the preceding claims, each of said panes being suspended from an overhead frame, there being provided an unfilled gap between adjacent panes of the order of 3 mm.

15. A court according to claim 14 further comprising a floor member adapted for mounting approximately one meter above ground level and wherein respective glass pane walls are suspended such that their lower edge portions are secured between a felt or like strip disposed around the floor edge and a second felt strip within a facia disposed in the plane of the floor.

* * * * *